United States Patent [19]

Mayhue

[11] 4,067,205

[45] Jan. 10, 1978

[54] SUPER COOLER FOR AN AIR CONDITIONING SYSTEM

[76] Inventor: Jack Mayhue, P.O. Box 2271, Clearwater, Fla. 33517

[21] Appl. No.: 703,680

[22] Filed: July 8, 1976

[51] Int. Cl.[2] ..... F25B 47/00; F28D 5/00; F25B 39/04

[52] U.S. Cl. ..... 62/279; 62/305; 62/506

[58] Field of Search ..... 62/279, 280, 305, 506, 62/277, 278

[56] References Cited

U.S. PATENT DOCUMENTS

| | | | |
|---|---|---|---|
| Re. 21,298 | 12/1939 | Nelson | 62/279 |
| 2,561,278 | 7/1951 | Hill | 62/279 |
| 2,963,885 | 12/1960 | Loewenthal | 62/279 |
| 3,306,067 | 2/1967 | Anglin | 62/279 |
| 3,427,005 | 2/1969 | Kuykendall | 62/305 |
| 3,926,000 | 12/1975 | Scofield | 62/305 |
| 3,938,352 | 2/1976 | Schmidt | 62/428 |
| 3,984,995 | 10/1976 | Starr et al. | 62/305 |
| 3,996,764 | 12/1976 | Gilmer | 62/279 |

FOREIGN PATENT DOCUMENTS

| | | | |
|---|---|---|---|
| 575,204 | 4/1933 | Germany | 62/279 |
| 510,573 | 8/1939 | United Kingdom | 62/279 |
| 582,227 | 11/1946 | United Kingdom | 62/279 |

*Primary Examiner*—Lloyd L. King

*Attorney, Agent, or Firm*—Stefan M. Stein; Robert F. Frijouf

[57] ABSTRACT

Water condensed from the air drawn over the refrigeration unit of an air conditioning system is collected and directed into a first chamber of a dual chamber reservoir where it is pumped through heat exchanger coils. The heat exchanger coils are placed upstream from the condenser and can be in thermally conductive contact with a fibrous heat exchanging air filter placed across the air intake port of the air-cooled refrigerant condenser for the system. The chilled condensate lowers the air intake temperature and if placed in thermally conductive contact with the filter, cools the filter also. The condensate is then directed to the top of the filter where it is poured onto the filter and allowed to flow down the fibrous surface, thereby evaporating. The latent heat of vaporization in this process further cools the filter which in turn, further reduces the air intake temperature. Any condensate not evaporated from the surface of the filter is collected in a trough at the bottom and returned to a second chamber in the dual chamber reservoir where it is mixed with previously cycled water. Excess water in the second chamber will overflow into the first chamber and will be recycled. The reduction in the air intake temperature for the air-cooled condenser results in a more efficient operation for the overall air conditioning system. A second heat exchanger unit can also be employed to enhance the forced air cooling of the refrigerant compressor.

23 Claims, 6 Drawing Figures

FIG. 2
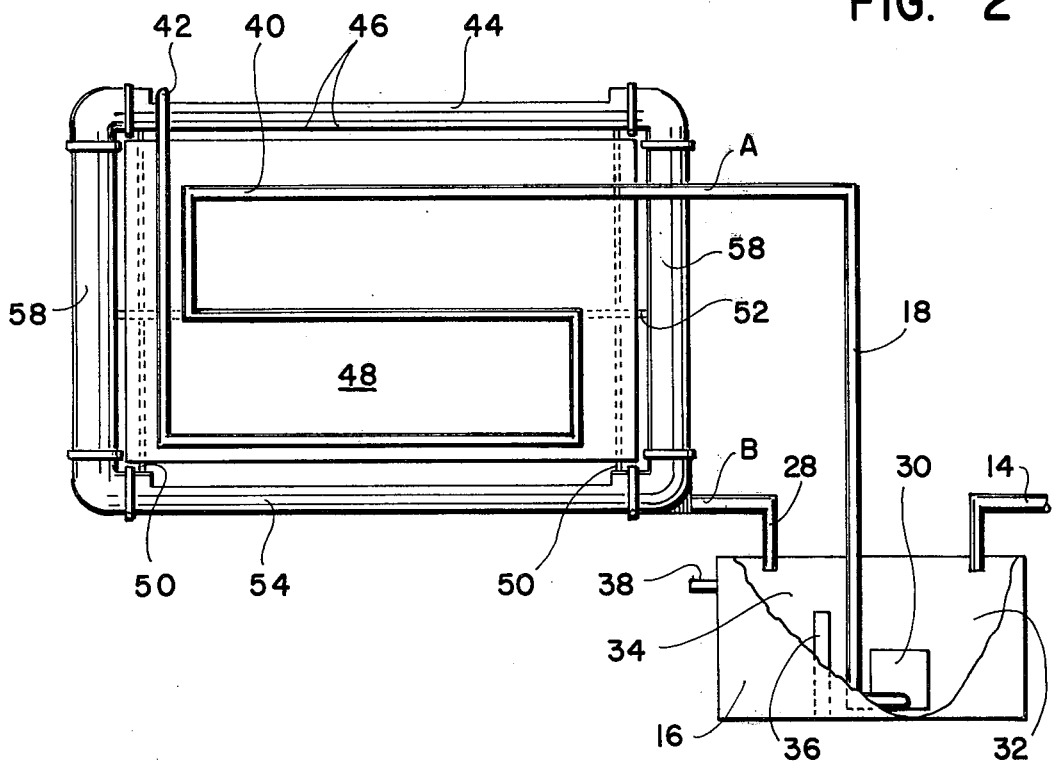
FIG. 3c
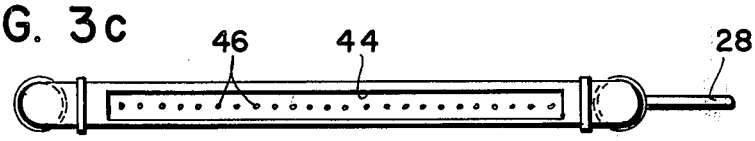
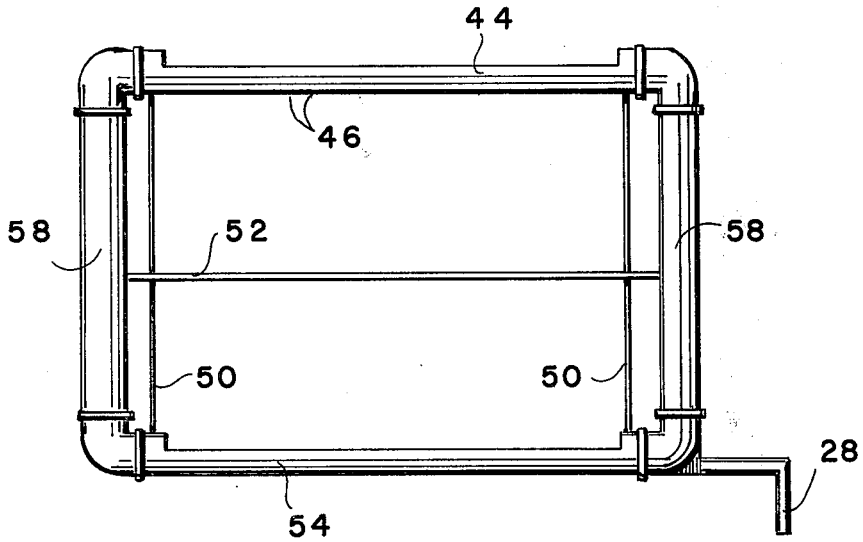
FIG. 3a
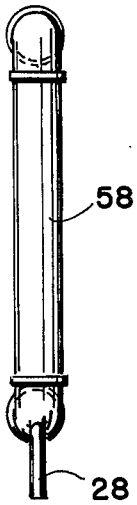
FIG. 3b

SUPER COOLER FOR AN AIR CONDITIONING SYSTEM

FIELD OF THE INVENTION

The invention disclosed relates to air conditioning systems and more particularly relates to improvements in the condensing of the refrigerant in an air conditioning system.

BACKGROUND OF THE INVENTION

A conventional air conditioner, especially smaller units for homes, includes an exterior portion including a forced air cooled compressor and condenser coil unit which is positioned in a self-contained housing outside of the home, and an evaporator and blower unit inside the home. The function of the condenser coil is to remove heat from the compressed refrigerant, which enters in a gas phase, thereby condensing the refrigerant to a liquid phase prior to entry in the evaporator coil. The liquid refrigerant subsequently expands to a cold gas in the evaporator coil, which cools air circulated past it by the blower inside the home.

The air conditioner is more efficient if the refrigerant leaves the condenser coil and enters the evaporator at a cool temperature. Moreover, since various refrigerants normally condense at temperatures within the range of 100°-130° F., a given refrigerant may not completely condense into a liquid in extremely hot weather, especially if the condenser is exposed to the sun and unshaded. Thus it is desirable to keep the condenser coil as cool as possible.

One technique disclosed in the prior art to cool the condenser coil has the lowermost condenser coils immersed in a water bath such that the coils are cooled by simple conduction. Heat transferred by the refrigerant to the water bath is dissipated by evaporation in the form of spraying the bath water in a fountain. Another technique disclosed in the prior art to cool the condenser coil in an automobile air conditioner, has the coil immersed in the water condensate which has been collected from moist ambient air which has passed over the refrigerant evaporator. None of the prior art techniques however can be easily adapted to an existing compressor/condensor housing in a domestic air conditioning system. None of the prior art mechanisms which carry out these techniques lend themselves to easy installation on an existing air conditioning system by the homeowner himself.

OBJECTS OF THE INVENTION

It is therefor an object of the invention to provide an improved air conditioning system.

It is another object of the invention to provide a means for more efficiently cooling a forced air cooled condenser coil in an air conditioning system.

It is still another object of the invention to provide a means to make an air conditioning system more efficient, which is easily installed on an existing unit.

It is yet another object of the invention to cool the condenser coils in an air conditioning unit in an improved manner.

It is a further object of the invention to cool the compressor in an air conditioning unit in an improved manner.

SUMMARY OF THE INVENTION

These and other objects, features and advantages of the invention are accomplished by the super cooler invention disclosed herein. Water condensed from the air drawn over the refrigeration unit of an air conditioning system is collected and directed into a first chamber of a dual chamber reservoir where it is pumped through heat exchanger coils. The heat exchanger coils are placed upstream of the condensor, thereby lowering the air intake temperature. Furthermore, the heat exchange coils can be in thermally conductive contact with a fibrous heat exchanging air filter placed across the air intake part of the air-cooled refrigerant condensor for the system. The chilled condensate would conductively cool the filter, lowering the air intake temperature. The condensate is then directed to the top of the filter where it is poured onto the filter and allowed to flow down the fibrous surface, thereby evaporating. The latent heat of vaporization in this process further cools the filter which, in turn, further reduces the air intake temperature. Scale deposits fail to form on the filter because the condensate is distilled water. Any condensate not evaporated from the surface of the filter is collected in a trough at the bottom and returned to a second chamber in the dual chamber reservoir where it is mixed with previously cycled water. Excess water in the second chamber will overflow into the first chamber and will be recycled. The reduction in the air intake temperature for the air-cooled condenser results in a more efficient operation for the overall air conditioning system. A second super cooler unit can also be employed to enhance the forced air cooling of the refrigerant compressor. The heat exchanger can be easily installed on the air intake port of an existing air-cooled condenser unit. It is suitable for domestic central type and window type air conditioners and can be installed by the homeowner using simple household tools.

DESCRIPTION OF THE FIGURES

These and other objects, features and advantages of the invention will be more readily appreciated upon reviewing the accompanying figures.

FIG. 2 is a detailed illustration of the super cooler invention.

FIG. 3*a* is a detailed front view of the construction of the heat exchanging air filter.

FIG. 3*b* is a side view of the filter of FIG. 3*a*.

FIG. 3*c* is a top view of the filter of FIG. 3*a*.

DISCUSSION OF THE PREFERRED EMBODIMENT

Figure 1:
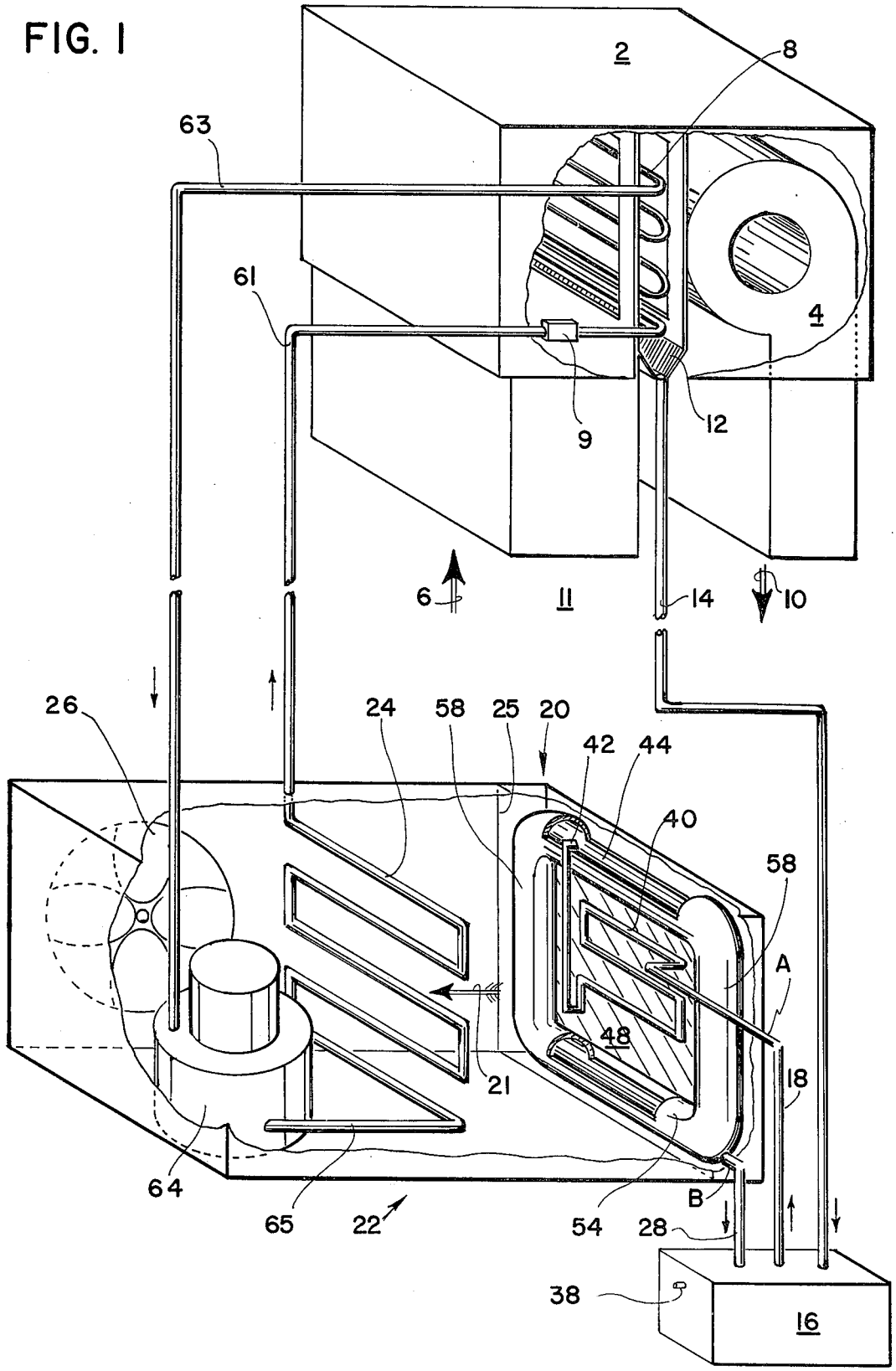
FIG. 1 illustrates the overall system context of the super cooler invention.

The system context for the super cooler invention is shown in FIG. 1 where a conventional air conditioner system is shown which includes a chilling portion 2 including a blower unit 4 for creating an air flow 6 into the unit from the compartment 11 to be cooled, drawing the air over the refrigerant evaporator coil 8 and then back in the direction 10 to the compartment 11. The system further includes the refrigerant compressing unit 22 containing a forced air cooled compressor 64 and condenser coil 24. The function of the condenser coil 24 is to remove heat from the refrigerant compressed by the compressor 64, which enters in a gas phase, thereby condensing the refrigerant into a liquid phase prior to entry in the evaporator coil 8 via the expansion valve 9. The liquid refrigerant subsequently expands to a cold gas in the evaporator coil 8, which cools the air 6 circulated past the evaporator 8 by the blower unit 4.

When the ambient air has a relative humidity of greater than approximately 45%, substantial quantities of water are condensed from the air flow 6 as it passes over the evaporator coil 8 in the refrigerating unit 2. This water condensate drips over the region of the coil 8 and collects in the collector 12, at a temperature of approximately 40° F. The water condensate is conducted from the collector 12 through a thermally insulated pipe 14 to an input of the pump 16.

Mounted on the air intake port 25 of the compressor housing 22 proximate to the condenser coil 24, is the super cooling unit 20 which includes the heat exchanger coil 40 and fibrous heat exchanging filter 48. The pump 16 pumps the chilled condensate through an output pipe 18 to the heat exchanger coil 40 in the super cooling unit 20, at the input A. The chilled condensate flowing through the heat exchanger coil 40 lowers the termperature of the air flow 21 flowing across the condenser coils 24, thereby augmenting the cooling of the condenser coils 24. The chilled condensate in the heat exchanger coil 40 is then conducted to the end 42 as is shown in FIG. 1, where it flows into a trough 44 containing a plurality of holes 46, shown to better advantage in FIG. 3*c*. Mounted beneath the holes 46 is the fibrous heat exchanging air filter 48 into which the chilled condensate is dripped so as to saturate the filter 48. The air flow 21 produced by the fan 26, passing through the fibrous heat exchanging air filter 48, induces evaporative cooling of the filter which in turn further reduces the air intake temperature for the air flow 21, further augmenting the cooling of the condenser coils 24. The super cooler thus chills the intake air to the condenser unit with a two-stage condensate cooling cycle.

Condensate which flows to the bottom of the filter 48 without evaporation, is collected in the U-shaped trough 54 and is directed from the super cooler 20 through the outlet B and through the pipe 28 to the pump 16.

The pump 16 is shown in FIG. 2 as a dual chambered pump having a first chamber 32 wherein the chilled condensate flowing from the input pipe 14 is pumped by the pump 30 to the super cooler's heat exchange coil 40 over the outlet pipe 18. Water which has circulated through the super cooler 20 and has been collected by the collector 54 is directed through the input pipe 28 to a second chamber 34 where the water is mixed with previously recycled water. The first chamber 32 is separated from the second chamber 34 by a dam 36 over which excess recycled water in the chamber 34 may flow, to be mixed with fresh condensate from the input pipe 14. Excess quantities of recycled water in the chamber 34 are eliminated from the system through the overflow pipe 38.

The super cooler 20 is employed as a subcooler for the condenser 24 on an air conditioner or other refrigeration system to substantially increase its efficiency. The pump 16 dissipates little power, having a motor of approximately 1/60th horsepower. Experimental trials of the super cooler system show that the power required to cool the compartment 11 can be reduced by 10–20%. The system is designed for use in geographical regions having high relative humidity, but can be used in environments having a relative humidity as low as 45%.

Several design modifications can be made with respect to the elements of the invention without departing from the spirit and scope of the invention. For example, the preferred material of which the fibrous heat exchanging filter is composed is hog's hair, plastic or fiberglass. The consideration to be made is first, that the solubility of the material be quite low in the water condensate so as not to cause the accumulation of any sludge in the system. The second consideration is the thermal conductivity of the material. A higher thermal conductivity for the filter 48 is desirable when placed in contact with the heat exchanger coil 40 if heat is desired to be extracted from the heat exchanger filter 48 by the coil 40. The effective surface are of the coil 40 is increased when the filter 48 is in conductive thermal contact with the heat exchanger coil 40. Other possible materials for the filter 48 can include stainless steel or chrome plated copper.

The super cooling assembly 20 is very convenient to install, requiring only two clamps to position it in front of the air intake port 25 of the condensor housing 22. FIG. 3*a* shows how the filtering material 48 is held in place within the frame formed by the pipes 44, 54, and 58, by means of plastic rods 50 and 52. In this manner, new filtering material can be easily replaced on a periodic basis without disassembly of the apparatus.

The pump 16 can be driven off the motor powering fan 26.

The entire assembly shown in FIG. 3 can be made from drip molded plastic or can be assembled from separate lengths of plastic pipe composed of, for example polyvinylchloride.

Figure 4:
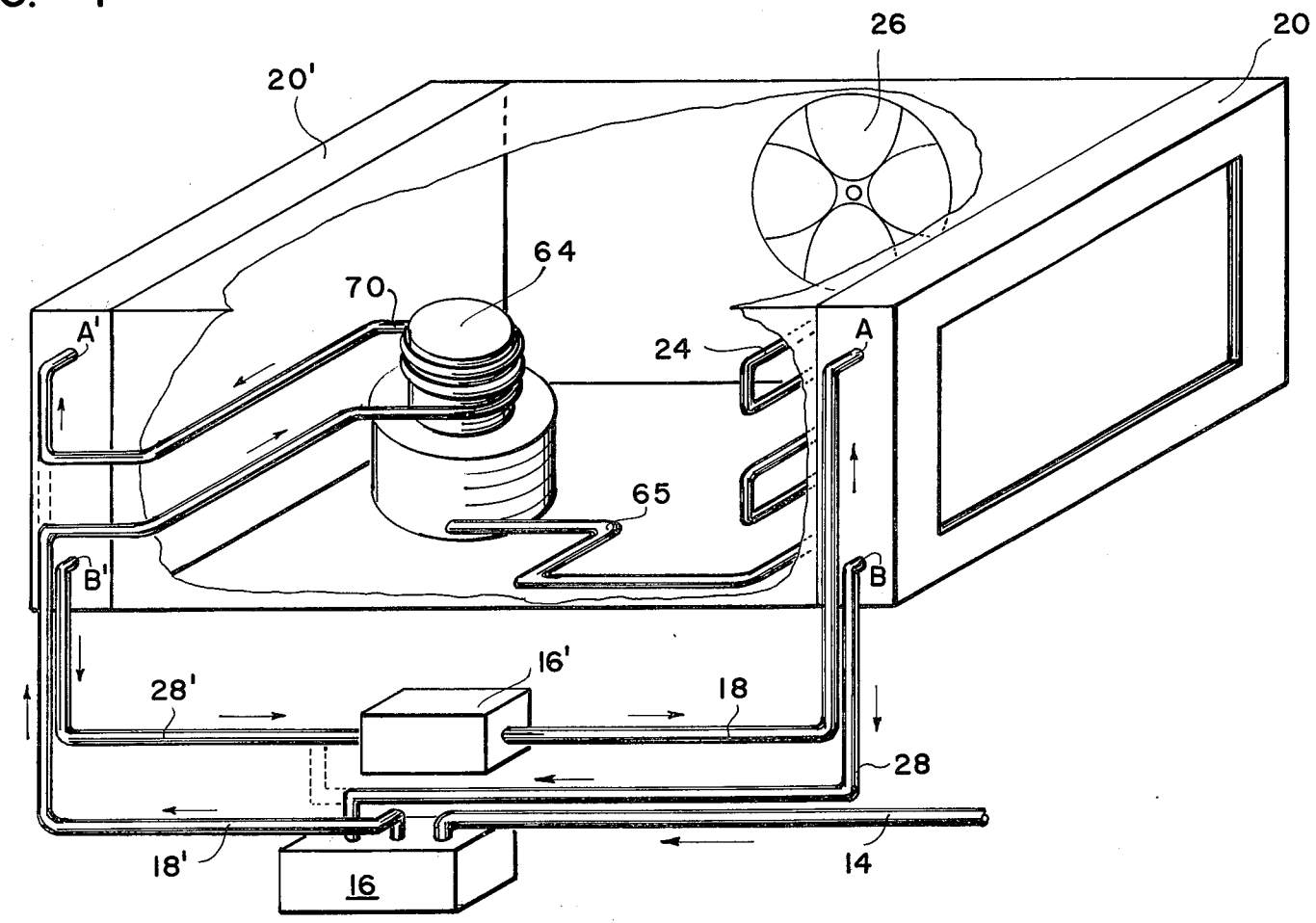
FIG. 4 illustrates an alternate embodiment employing a second super cooler to cool the refrigerant compressor.

FIG. 4 illustrates an alternate embodiment of the invention wherein the condensate pumped by the pump 16 is output over the pipe 18° to two super cooling units 20' and 20, cooling the refrigerant compressor 64 and the condenser coils 24, respectively.

In one embodiment, the pipe 18' can be optionally wrapped about the compressor 64 as the coil 70 to conductively cool the compressor 64. Coil 70 then returns to the pipe 18' which directs the condensate to the input A' of the super cooler 20' of FIG. 4. Super cooler 20' of FIG. 4 is identical to the super cooler 20 shown in FIGS. 1, 2 and 3, with the input A' corresponding to A and the output B' corresponding to the output B. After the water has completely flowed through the super cooler 20' it passes via output B' to the pipe 28' and can optionally return to the pump 16 or, through an auxilliary pump 16', be pumped through pipe 18 to the input A of the super cooler 20. The super cooler 20 shown in FIG. 4 works identically to that shown in FIG. 1. The addition of this pre-cooling system 20' increases the condensate temperature somewhat, estimated to be between 4° and 10° F, and therefore decreases somewhat the efficiency of the super cooler 20 cooling the condenser 24. However, the overall efficiency of the system is increased by the use of the auxiliary super cooler 20' cooling the refrigerant compressor 64.

In another alternate embodiment water from any source would be supplied to the input of pump 16 with that water being used instead of the condensate in the system.

Means to supply city water or well water could be used. It is likely that the efficiency of this embodiment would be reduced since the temperature of the supplied water would be much higher than the chilled condensate.

The reduction of the air intake temperature for the air cooled condenser coils 24 and compressor 64 results in a more efficient operation of the overall air conditioning system. The heat exchanger can be easily installed on the air intake port 25 on an existing air cooled condenser unit. It is suitable for central type and window type air conditioners and can be installed on domestic units by the homeowner using simple household tools. The super cooler chills the intake air to the condenser unit with a two-stage condensate cooling cycle generated by a simplified structure which is easily fabricated, easily installed, and easily maintained.

Although this invention has been described with some specificity, it is understood that the present disclosure is made only by way of example and that many changes in the details of construction and the combination and arrangement of the elements may be made without departing from the spirit and the scope of this invention.

I claim:

1. In a system for refrigerating air in a compartment, including a refrigerant compressor, a condenser coil connected to the output of said compressor for cooling the compressed refrigerant, a first fan located proximate to said condenser coil moving an air flow across said condensor coil for forced air cooling of the coil, a refrigerant evaporator located proximate to said compartment, having its input connected to the output of said coil, and a second fan located proximate to said compartment, for moving air across said evaporator and into said compartment for cooling the compartment, the improvement of which comprises:

a first collecting means proximate to said evaporator for collecting chilled water condensate from the air which has been cooled as it was moved across said evaporator by said second fan;

means for cooling said air flow across said condenser coil by said first fan, comprising:

a fibrous heat exchanging air filter located upstream from said condenser coil in the air flow produced by said first fan;

a heat exchanging coil having an input connected to said means for collecting water condensate, located upstream from said condenser coil in the air flow produced by said first fan and proximate to said air filter, for conducting said chilled water condensate for absorbing heat from said air flow over the heat exchanging coil;

said heat exchanging coil conducting said chilled water condensate so as to flow onto said heat exchanging air filter where said air flow through the filter is further cooled by evaporative cooling.

2. The apparatus of claim 1, which further comprises:

said filter having a second collector for collecting excess condensate which has not evaporated from the filter;

a pump connected between said first collecting means and said heat exchanging coil, having a first chamber connected to the output of said first collecting means, for receiving the chilled condensate and pumping it to said heat exchange coil, and a second chamber connected to receive said excess condensate for mixing with previously recycled condensate, from said second collector, said second chamber communicating with said first chamber by means of an overflow passage;

whereby chilled condensate received directly from said first collecting means is initially pumped to said heat exchanger coil and then after the excess condensate is collected from said filter by said second collector, it is mixed with the chilled condensate and recirculated to the filter, maximizing the cooling of the condenser coil.

3. The apparatus of claim 1, wherein said heat exchanging coil is in thermally conductive contact with said fibrous heat exchanging air filter;

whereby said heat exchanging coil has a greater surface area with said air flow for enhanced heat exchange.

4. The apparatus of claim 2, wherein said heat exchanging coil is in thermally conductive contact with said fibrous heat exchanging air filter;

whereby said heat exchanging coil has a greater surface area with said air flow for enhanced heat exchange.

5. The apparatus of claim 1, wherein said fibrous heat exchanging air filter is composed of materials selected from the group consisting of hog's hair, plastic and fiberglass.

6. The apparatus of claim 2, wherein said fibrous heat exchanging air filter is composed of materials selected from the group consisting of hog's hair, plastic and fiberglass.

7. The apparatus of claim 1, which further comprises:

said heat exchange coil being wrapped around the housing of said compressor to cool the compressor by thermal conduction.

8. The apparatus of claim 2, wherein said filter further comprises:

a substantially rectangular frame having an upper and lower horizontal components which are hollow pipes;

said upper pipe having a plurality of holes along its bottom surface;

said lower pipe serving as said second collecting means, having its upper side open to form a U-shaped cross section;

a fibrous mat clamped within the frame, beneath said holes in said upper pipe and above said lower pipe.

9. The apparatus of claim 8, wherein said pipes are composed of polyvinylchloride.

10. The apparatus of claim 8, wherein said filter is clamped over an air intake port of a housing containing said condenser coils.

11. The apparatus of claim 1, which further comprises:

said refrigerant compressor located proximate to said first fan so as to be exposed to said air flow, for forced air cooling thereof;

means for cooling said air flow across said compressor, comprising:

a second fibrous heat exchanging air filter located upstream from said compressor in said air flow;

a second heat exchanging coil having an input connected to said means for collecting water condensate, located upstream from said compressor in said air flow, proximate to said air filter, for collecting water condensate, for conducting said chilled water condensate for absorbing heat from said air flow over said second heat exchanging coil;

said second heat exchanging coil conducting said chilled water condensate so as to flow onto said heat exchanging air filter where said air flow through the filter is further cooled by evaporative cooling.

12. The apparatus of claim 11, which further comprises:

said second filter having a third collector for collecting excess condensate which has not evaporated from said second filter;

said pump having an input connected to said third collector.

13. In a system for refrigerating air in a compartment, the system including a refrigerant compressor connected to a condenser coil for cooling the compressed refrigerant and a refrigerant evaporator for receiving the cooled compressed refrigerant and located for cooling the compartment, the improvement comprising:

collecting means for collecting chilled water condensed from the air by action of the refrigerant evaporator;

heat exchanger means including a heat exchanger coil located upstream relative to the air flow to the condenser coil;

means for connecting said collecting means to said heat exchanger means to direct the chilled water through said heat exchanger coil for cooling the air flow to the condenser coil; and said heat exchanger means directing the chilled water from said heat exchanger coil to flow onto said heat exchanger means to further cool the air flow to the condenser coil by evaporative cooling on said heat exchanger means.

14. The apparatus of claim 13, wherein said heat exchanger means comprises:

a heat exchanging air filter located upstream relative to the air flow to the condenser coil.

15. The apparatus of claim 14, wherein the chilled water is poured over said heat exchanging air filter for cooling the air flow to the condenser coil by evaporative cooling.

16. The apparatus of claim 15, wherein said heat exchanger coil comprises an inlet connected to said collecting means and an outlet for pouring the chilled water on said heat exchanging filter.

17. The apparatus of claim 16, wherein said heat exchanger coil is in thermal conductive contact with the condenser coil for effectively increasing the effective surface area of said heat exchanger coil.

18. In a system for refrigerating air in a compartment, the system including a refrigerant compressor connected to a condenser coil for cooling the compressed refrigerant and a refrigerant evaporator connected for receiving the cooled compressed refrigerant and located for cooling the compartment, the improvement comprising:

collecting means for collecting chilled water condensed from the air by action of the refrigerant evaporator;

heat exchanger means including a heat exchanger coil located upstream relative to the air flow to one of the condenser coils and the compressor;

means for connecting said collecting means to said heat exchanger means to direct the chilled water through said heat exchanger coil for cooling the air flow to one of the condenser coil and the compressor; and said heat exchanger means directing the chilled water from said heat exchanger coil to flow onto said heat exchanger means to further cool the air flow to one of the condenser coil and the compressor by evaporative cooling on said heat exchanger means.

19. In a system for refrigerating air in a compartment, the system including a refrigerant compressor connected to a condenser coil for cooling the compressed refrigerant and a source of cooling liquid, the improvement comprising:

heat exchanger means including a heat exchanger coil located upstream relative to the air flow to the condenser coil;

means for connecting the source of cooling liquid to said heat exchanger means to direct the cooling liquid through said heat exchanger coil for cooling the air flow to the condenser coil; and said heat exchanger means directing the cooling liquid from said heat exchanger coil to flow onto said heat exchanger means to further cool the air flow to the condenser coil by evaporative cooling on said heat exchanger means.

20. In a system for refrigerating air in a compartment, the system including a refrigerant compressor connected to a condenser coil for cooling the compressed refrigerant and a refrigerant evaporator connected for receiving the cooled compressed refrigerant and located for cooling the compartment; the improvement comprising:

collecting means for collecting chilled water condensed from the air by action of the refrigerant evaporator;

heat exchanger means located upstream relative to the air flow to the condenser coil;

compressor coil means in thermal conductive connection with the refrigerant compressor; and means for connecting said collecting means to said heat exchanger means and said compressor coil means for precooling the air prior to contact with the condenser coil and for reducing the temperature of the refrigerant compressor.

21. The apparatus of claim 20, wherein said connecting means connects said collecting means to said heat exchanger means and connects said heat exchanger means to said compressor coil.

22. The apparatus of claim 20, wherein said connecting means include pump means for pumping the chilled condensed water to said heat exchanger means and said condenser coil.

23. The apparatus of claim 20, wherein said heat exchanger means includes a first and a second heat exchanger respectively located relative to the air flow to the condenser coil and the refrigerant compressor; and said compressor coil being connected in series with the water flow relative to said second heat exchanger.

* * * * *